US007211733B2

(12) United States Patent
Kurimoto et al.

(10) Patent No.: US 7,211,733 B2
(45) Date of Patent: May 1, 2007

(54) ELECTRIC WIRE, ELECTRIC WIRE CONNECTION METHOD AND WIRE HARNESS

(75) Inventors: Akinori Kurimoto, Niimi (JP); Kouji Fujita, Nasu-gun (JP); Hiroshi Yamashita, Gotenba (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/554,914

(22) PCT Filed: Apr. 27, 2004

(86) PCT No.: PCT/JP2004/006051

§ 371 (c)(1),
(2), (4) Date: Oct. 31, 2005

(87) PCT Pub. No.: WO2004/100181

PCT Pub. Date: Nov. 18, 2004

(65) Prior Publication Data

US 2006/0225909 A1 Oct. 12, 2006

(30) Foreign Application Priority Data

May 7, 2003 (JP) ..... 2003-129161

(51) Int. Cl.
*H01B 7/00* (2006.01)

(52) U.S. Cl. ..... 174/110 R; 174/112

(58) Field of Classification Search ..... 174/110 R, 174/112, 113 R

See application file for complete search history.

(56) References Cited

U.S. PATENT DOCUMENTS

| | | | | | |
|---|---|---|---|---|---|
| 1,607,432 | A * | 11/1926 | Bryce | 174/112 |
| 3,197,554 | A * | 7/1965 | Baker | 174/112 |
| 4,387,665 | A * | 6/1983 | Clinton | 118/674 |
| 4,997,994 | A * | 3/1991 | Andrews et al. | 174/112 |
| 5,142,105 | A * | 8/1992 | Kihlken et al. | 174/112 |
| 5,645,899 | A * | 7/1997 | Unterberger | 427/558 |
| 6,388,194 | B1 * | 5/2002 | Ryeczek | 174/112 |
| 2006/0021785 | A1 * | 2/2006 | Kamata et al. | 174/112 |

FOREIGN PATENT DOCUMENTS

| | | | |
|---|---|---|---|
| JP | 6-223639 | A | 8/1994 |
| JP | 8-190814 | A | 7/1996 |
| JP | 10-031918 | A * | 2/1998 |
| JP | 11-297129 | A * | 10/1999 |
| JP | 2001-35266 | A | 2/2001 |
| JP | 2002-109976 | A | 4/2002 |
| JP | 2003-168329 | A * | 6/2003 |

* cited by examiner

*Primary Examiner*—William H. Mayo, III
(74) *Attorney, Agent, or Firm*—Sughrue Mion, PLLC

(57) ABSTRACT

A first marking and a second marking, indicating a connection form, are provided on a covering sheath at a connection position of a first wire serving as a main wire. Therefore, an operation is carried out at a region between the first marking and the second marking of the first wire according to an operation form indicated by the second marking. Therefore, the predetermined form of operation can be carried out at the predetermined position of the first wire.

9 Claims, 10 Drawing Sheets

ELECTRIC WIRE, ELECTRIC WIRE CONNECTION METHOD AND WIRE HARNESS

TECHNICAL FIELD

This invention relates to a wire, a wire connecting method and a wire harness.

BACKGROUND ART

In a conventional ordinary method of connecting a branch wire to a main wire, first, a distal end 100*a* of the branch wire 100 is exposed, and a cut 102 is formed in a sheath 101*a* at a connecting region of the main wire 101 as shown in FIG. 11(A).

Then, as shown in FIG. 11(B), the sheath 101*a* of the main wire 101 is shifted a distance of about 20 mm to about 30 mm, thereby exposing a connecting portion 103, and the distal end 100*a* of the branch wire 100 is connected to the connecting portion 103 by soldering or press-clamping.

In this case, the position in which the cut 102 is to be formed in the main wire 101 need to be determined by measuring the length each time this operation is effected, and this is cumbersome.

Therefore, it has now been brought into practice to provide a mark on the wire connecting region (see, for example, JP-A-2002-109976 (Pages 3 and 4, FIG. 2)).

For example, in the case of connecting another wire by press-contacting to a desired wire among a plurality of wires packed into a bundle, a marking, indicative of the wire to be subjected to the press-contacting and also of a press-contacting position, is provided on the press-contacting portion or its vicinity, and the above another wire is connected by press-contacting to this wire.

By doing so, an error in selecting the wire to be connected can be prevented, and also the connection can be effected at the predetermined position, so that the efficiency of the operation can be improved.

In the above-mentioned technique, however, merely the connecting region at the wire is indicated, and therefore a connection form and others such as an operation form can not be indicated, and each time the operation is carried out, the operation need to be effected while confirming a manual, and this is cumbersome.

DISCLOSURE OF THE INVENTION

This invention has been made in view of the above problem, and its object is to provide a wire, a wire connecting method and a wire harness, in which a proper operation can be carried out while easily recognizing the contents of the operation to be applied to the wire.

(1) In order to achieve the above object, a wire of the present invention has an indicating member which indicates an operation region, and is provided on a covering sheath, and the indicating member includes a first marking and a second marking which are provided at a predetermined interval along a longitudinal direction of the covering sheath, and the first marking indicates an operation position, and the second marking indicates an operation form.

(2) Further, preferably, the first marking of the wire of the above (1) indicates the operation position lying between the first marking and the second marking.

When the wire is constructed as in the above (1) or the above (2), for example, an operation whose operation form is indicated by the second marking is carried out at the region between the first marking and the second marking which are the indicating member provided on the covering sheath of the wire, and therefore the predetermined operation can be carried out errorlessly at the predetermined position without consulting a manual or the like.

(3) Further, preferably, the first marking of the wire, constructed as in the above (1) or the above (2) indicates a connecting position to which a branch wire is to be connected, and the second marking indicates the number of the branch wire and an installation direction thereof.

When the wire is constructed as in the above (3), at the region between the first and second markings provided on the covering sheath of the main wire to which the branch wire is to be connected, the branch wire whose number is indicated by the second marking is connected in the installation direction indicated by the second marking, and therefore a plurality of branch wires can be connected to the main wire at the predetermined position in the predetermined direction.

(4) Further, preferably, at least one of the first marking and the second marking of the wire, constructed as in any one of the above (1) to (3), is formed by a heat-sensitive paint.

In the wire constructed as in the above (4), at least one of the first marking and the second marking is formed by the heat-sensitive paint, and therefore when solder is used for connecting the branch wire to the main wire, the portion, formed by the heat-sensitive paint, is changed in color. Therefore, imperfect soldering, the omission of the soldering or the like can be easily detected. Here, the heat-sensitive paint means a paint which is changed in color upon application of heat of above a predetermined temperature.

(5) In order to achieve the above object, a wire connecting method of the present invention for connecting a second wire, serving as a branch wire, to a predetermined position of a first wire serving as a main wire comprising the steps of beforehand providing a first marking and a second marking at a predetermined interval along a longitudinal direction of a covering sheath of the first wire; connecting the second wire according to a connecting position which is indicated by the first marking, and lies between the first marking and the second marking; and installing the second wire according to a connection form indicated by the second marking.

In the wire connecting method constructed as in the above (5), the first marking and the second marking are beforehand provided on the covering sheath at the connection position of the first wire serving as the main wire to which the second wire (serving as the branch wire) is to be connected. Then, the second wire is connected to the first wire at the region between the first marking and the second marking. At this time, the connection is effected according to the connection form indicated by the second marking, and therefore the second wire can be connected in the predetermined form to the predetermined position of the first wire without consulting a manual or the like.

(6) In order to achieve the above object, a wire harness of the present invention is formed by the wire connecting method of the above (5).

In the wire harness of the above (6), the first marking and the second marking, indicating the connection form, are provided on the covering sheath at the connecting position of the first wire serving as the main wire, and therefore at the region between the first marking and the second marking of the first wire, the second wire (serving as the branch wire) is connected according to the connection form indicated by the second marking. Therefore, the second wire can be connected to the predetermined position of the first wire without consulting a manual or the like.

Figure 1:
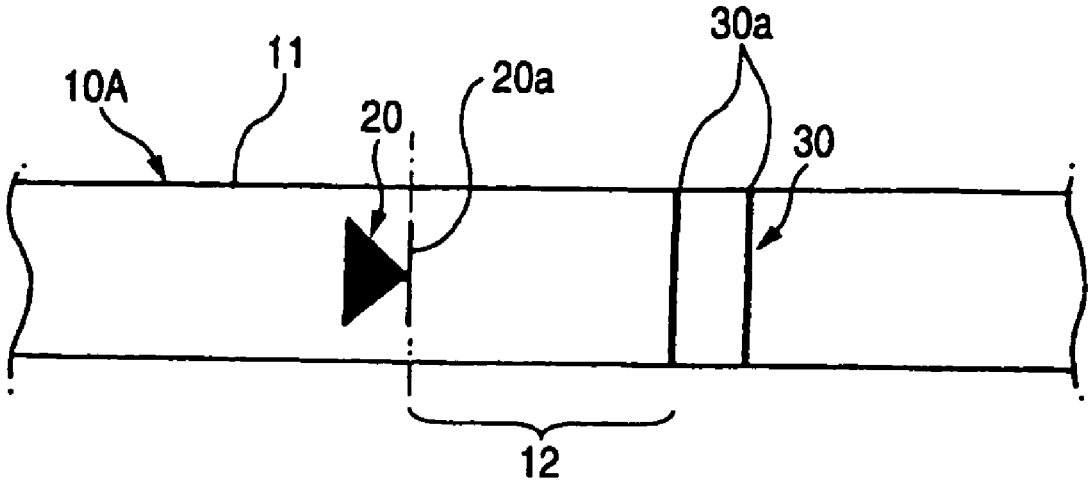
FIG. 1 is an explanatory view showing a wire, a wire connecting method and a wire harness according to a first embodiment of the present invention.

In the drawings, reference numeral 10 denotes a wire (first wire), 11*a* covering sheath, 20, 21, 23, 24, 25 and 26 a first marking (indicating member), 30, 31, 34, 35, 37 and 38 a second marking (indicating member), 40*a* branch wire (second wire), and 60*a* wire harness.

BEST MODE FOR CARRYING OUT THE INVENTION

A wire, a wire connecting method and a wire harness, according to a first embodiment of the present invention, will now be described in detail with reference to the drawings. FIG. 1 is an enlarged view of the first embodiment of the wire of the present invention, FIG. 2 is an explanatory view showing the first embodiment of the wire connecting method of the present invention, and FIG. 3 is an enlarged view of a connecting portion.

As shown in FIG. 1, in the wire 10A serving as a first wire according to the first embodiment of the present invention, a first marking 20 and a second marking 30 are provided on a covering sheath 11, and are arranged at a predetermined interval. The first marking 20 indicates an operation position. More specifically, the first marking 20 indicates that the operation position lies between the first marking 20 and the second marking 30, and this first marking has a portion 20*a* indicating one end limit of an operation range 12.

On the other hand, the second marking 30 indicates the other end limit of the operation range 12, and also indicates an operation form.

Figure 2:
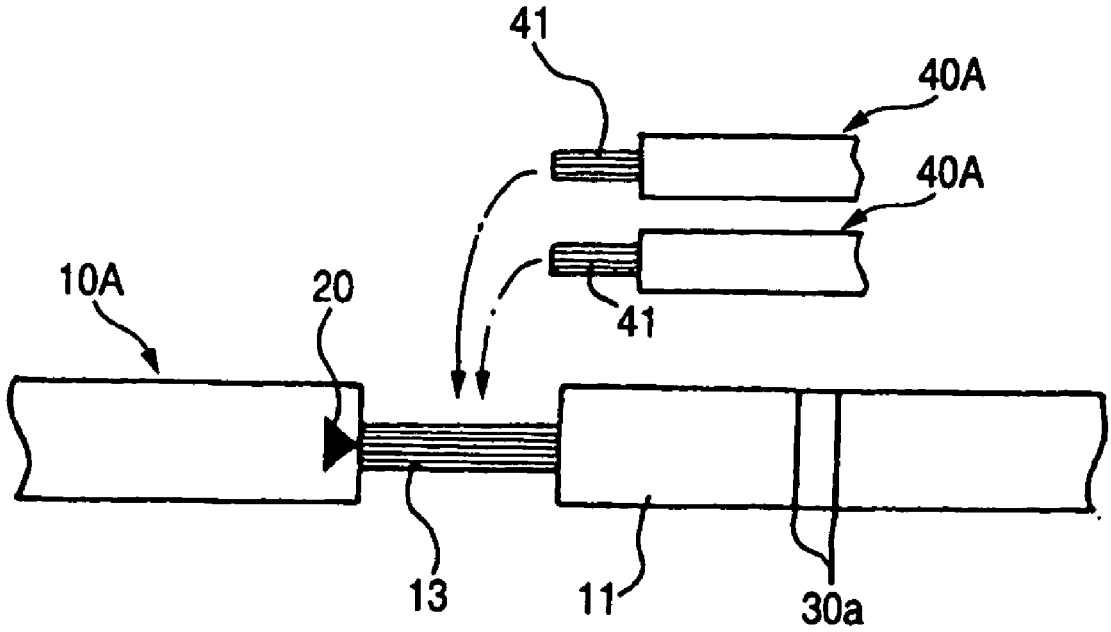
FIG. 2 is view explanatory of a first marking and a second marking.
Figure 3:
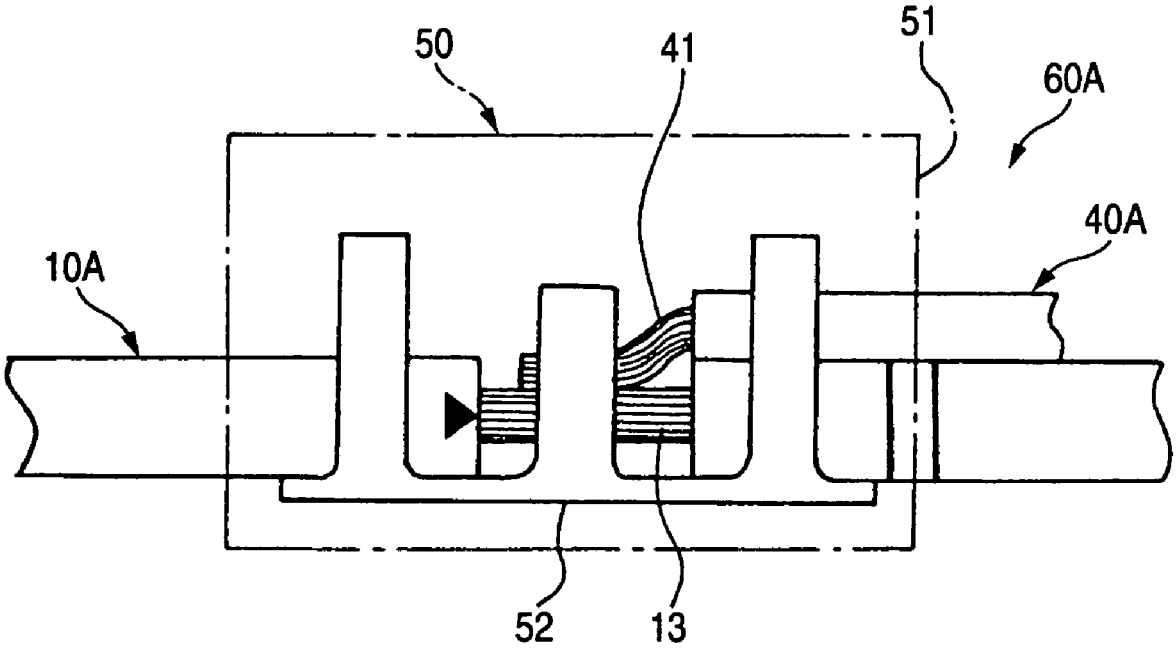
FIG. 3 is an explanatory view showing a condition in which a branch wire is connected to the wire.

As shown in FIG. 2, two rings 30*a*, 30*a* are provided, and the ring 30*a* indicates that contents of the operation are the operation for connecting branch wires 40 which are second wires. At the same time, the provision of the two rings 30*a* indicates that the number of branch wires 40A to be connected is two.

Therefore, in the wire connecting method of the present invention, the covering sheath 11 of the wire 10A (which is the main wire) is cut within the operation range 12 lying between the first marking 20 and the second marking 30, thereby providing an exposed portion 13 as shown in FIG. 2.

Distal ends 41 of the two branch wires 40A are superposed on this exposed portion 13, and for example, a terminal 52, provided within a housing 51 of a joint connector 50, is press-fastened, thereby connecting the wire 10A and the branch wires 40A together in a press-clamped manner. In this manner, the wire harness 60A is formed.

As described above, in the above-mentioned wire, wire connecting method and wire harness, the operation whose operation form is indicated by the second marking 30 is carried out between the first marking 20 and the second marking 30 which are the indicating member provided on the covering sheath 11 of the wire 10A, and therefore the predetermined operation can be carried out at the predetermined position without a mistake.

At this time, it is not necessary to see other materials such as a manual, and therefore the wire harness 60A can be easily formed.

Figure 4:
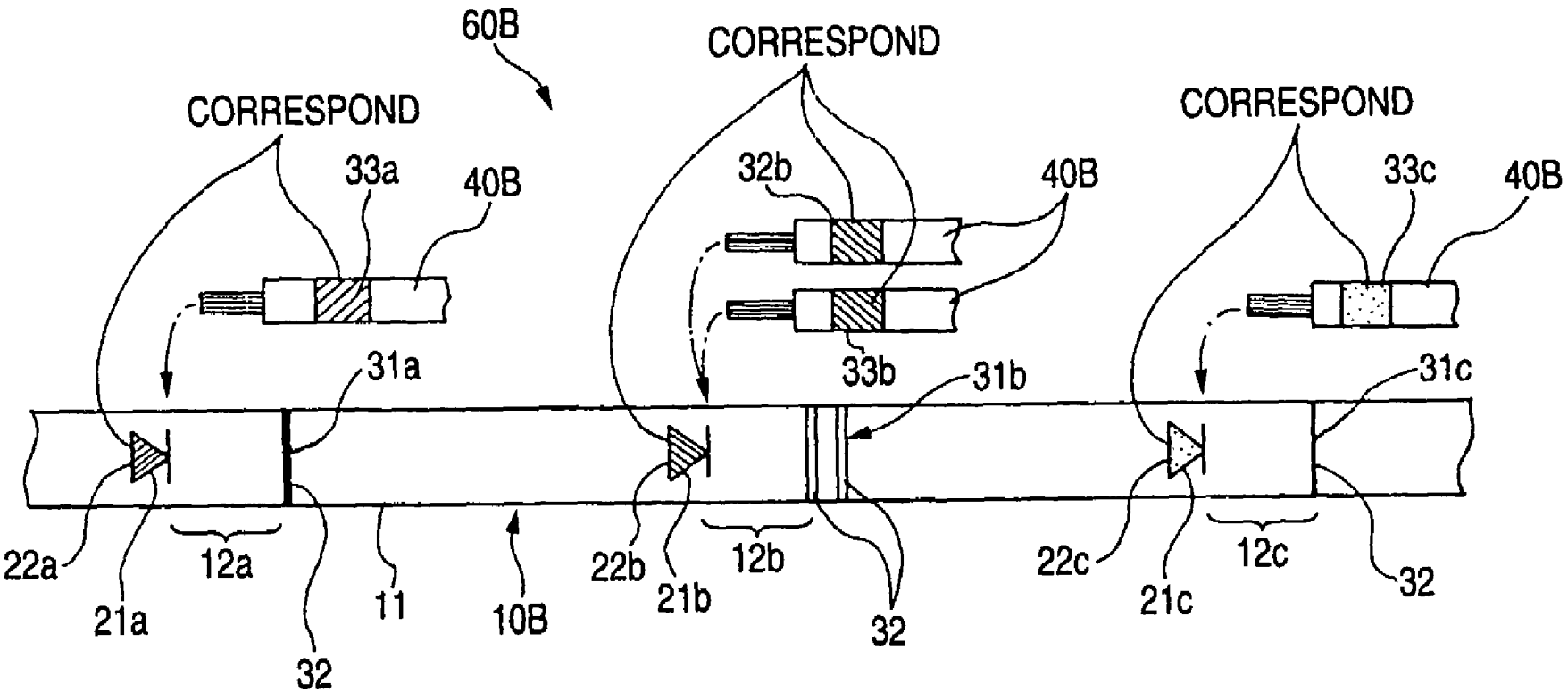
FIG. 4 is an explanatory view showing a wire, a wire connecting method and a wire harness according to a second embodiment of the present invention.

Next, a wire, a wire connecting method and a wire harness, according to a second embodiment of the present invention, will be described in detail with reference to the drawings. FIG. 4 is an enlarged view of the second embodiment of the wire of the present invention.

Those portions identical to those of the above-mentioned embodiment will be designated by identical reference numerals, respectively, and repeated explanation will be omitted.

As shown in FIG. 4, a plurality of (here, three) pairs of first markings 21*a*, 21*b*, 21*c* and second markings 31*a*, 31*b*, 31*c* are provided on a covering sheath 11 of the wire 10B of the second embodiment of the present invention. Each of the first markings 21*a*, 21*b*, 21*c* indicates that an operation position lies between the first marking and the corresponding second marking 31*a*, 31*b*, 31*c*, and also each first marking has a portion indicating one end limit of an operation range 12*a*, 12*b*, 12*c*.

The second markings 31*a*, 31*b*, 31*c* have respective described rings 32, and therefore each operation form is a connecting operation. Two rings 32 are described only at the central marking 31*b*, and therefore it will be appreciated that there are two branch wires 40B to be connected.

At the same time, a mark 22, described at the first marking 21, corresponds to a mark 33 described at an end-adjacent portion of the branch wire 40B which is to be connected relative to this first marking 21.

For example, the mark 22*a* of the first marking 21*a* and the mark 33*a* of the branch wire 40B (which correspond to the left connecting position) both have a right-upper oblique-line hatching pattern. At the central connecting position, the two marks 22*b* and 33*b* both have a right-lower oblique-line hatching pattern, and at the right connecting position, the two marks 22*c* and 33*c* both have a dotted pattern.

The wire connecting method of the present invention for connecting the wire 10B and the branch wires 40B at each of the operation positions 12*a*, 12*b*, 12*c* is totally identical to the method described above for the first embodiment, and therefore explanation thereof is omitted.

As described above, in the above-mentioned wire, wire connecting method and wire harness, the operation is carried out according to the first markings 21 and the contents of the marks 32 described at the second markings 31, and by doing so, the proper connecting operations can be carried out even in the case where the branch wires 40B are connected respectively to the plurality of portions of the single wire 10B.

At this time, the connecting operation is carried out in such a manner that the mark 22, provided on each connecting portion of the wire 10B, coincides with the mark 33 provided on the branch wire 40B, and therefore a mistake can be prevented. And besides, it is not necessary to see other materials such as a manual, and therefore the wire harness 60B can be easily formed.

Figure 5:
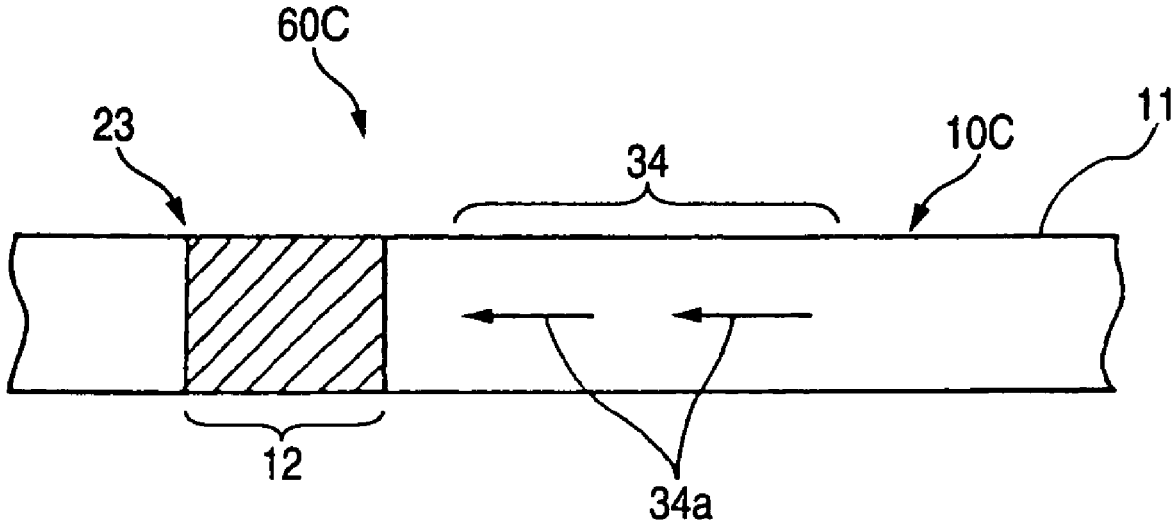
FIG. 5 is an explanatory view showing a wire, a wire connecting method and a wire harness according to a third embodiment of the present invention.

Next, a wire, a wire connecting method and a wire harness, according to a third embodiment of the present invention, will be described in detail with reference to the drawings. FIG. 5 is an enlarged view of the wire according to the third embodiment of the present invention.

Those portions identical to those of the above-mentioned embodiments will be designated by identical reference numerals, respectively, and repeated explanation will be omitted.

As shown in FIG. 5, a first marking 23 and a second marking 34 are provided on a covering sheath 11 of the wire 10C of the third embodiment of the present invention. The first marking 23 has a hatching of a predetermined width, and indicates an operation range 12. The second marking 34 consists of two arrows 34*a*, 34*a*, and indicates that the number of branch wires (not shown) to be connected to the wire 10C is two and that the branch wires should are installed from the right. Therefore, the branch wires are installed in the right direction from the hatching portion defining the operation range 12.

The wire connecting method of connecting the wire 10C and the branch wires together at the operation position 12 is totally identical to that described above for the first embodiment, and therefore explanation thereof is omitted.

As described above, in the above-mentioned wire, the wire connecting method and wire harness, the operation is carried out according to the contents described at the first and second markings 23 and 34, and by doing so, the proper connecting operation can be carried out.

At this time, it is not necessary to see other materials such as a manual, and therefore the wire harness 60C can be easily formed.

In the first to third embodiments, the wire 10*a*, 10B, 10C and the branch wire 40A, 40B are connected together by press-clamping, thermal welding or others, and as a protection form or a waterproofing form for the connected portions obtained after connecting these wires, the following four can be proposed.

1: To wind an adhesive tape on the connected portion

2: To wind an adhesive tape after soldering the connected portion

3: To cover the connected portion with a water stop material such as butyl rubber after soldering it and then to wind an adhesive tape 4: To wind an adhesive tape after covering the connected portion with a water stop material such as butyl rubber By selecting the suitable color, pattern, thickness, length, etc., of the rings and arrows, the second markings 30, 31, 34 in the first to third embodiments can indicate the protection form for the above connected portion so as to indicate the operator of the operation form.

Also, the first marking and the second marking can be described by the use of a heat-sensitive paint. In this case, when the wire and the branch wire are joined together by soldering, the color of the heat-sensitive paint is changed by heat of the solder, and therefore the omission of the soldering and the imperfect soldering can be easily detected.

Figure 6:
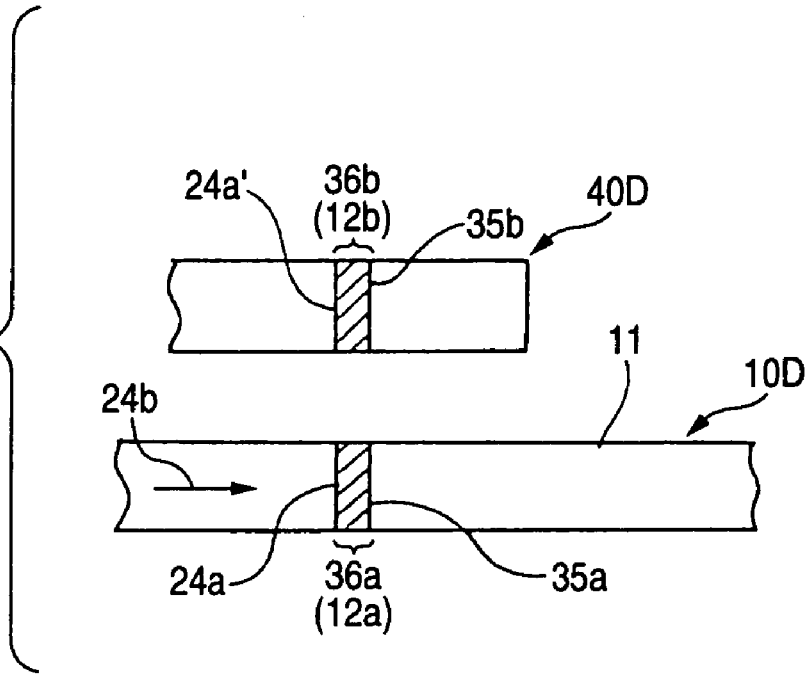
FIGS. 6(A) and 6(B) are explanatory views showing a wire, a wire connecting method and a wire harness according to a fourth embodiment of the present invention.
Figure 6:
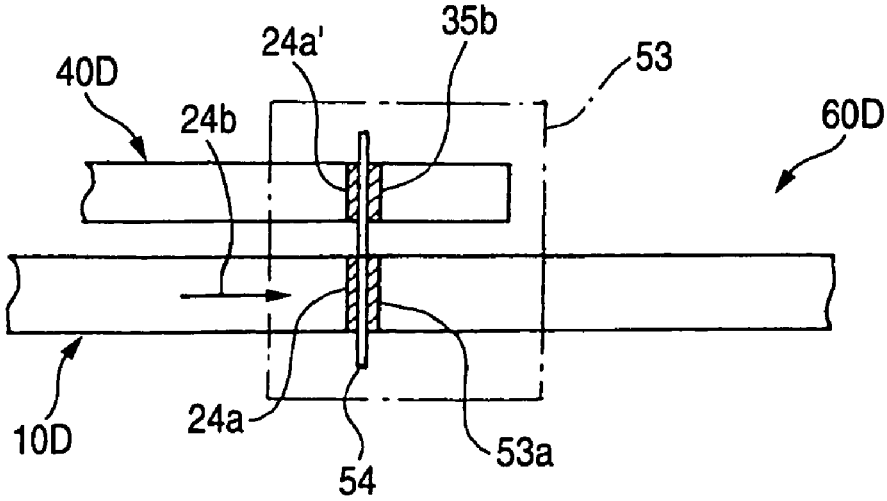

Next, a wire, a wire connecting method and a wire harness, according to a fourth embodiment of the present invention, will be described in detail with reference to the drawings. FIGS. 6(A) and 6(B) are enlarged views of the wire according to the fourth embodiment of the present invention.

Those portions identical to those of the above-mentioned embodiments will be designated by identical reference numerals, respectively, and repeated explanation will be omitted.

As shown in FIG. 6(A), a first marking 24*a* and a second marking 24*b* are provided on a covering sheath 11 of the wire 10D of the fourth embodiment of the present invention.

The first marking 24*a* is a ring-like mark, and a hatching portion 36*a* defines an operation range.

The second marking 24*b* consists of one arrow, and indicates that the number of the branch wire 40D to be connected to the wire 10D is one and that the branch wire is installed from the left. Therefore, the branch wire 40D is installed in the left direction from the hatching portion 36*a* defining the operation range. The hatching 36*a* indicates a form of operation for effecting the joining by a press-contacting joint connector 53.

On the other hand, a first marking 24*a*' similar to the first marking 24*a* of the wire 10D is provided on the branch wire 40D, and a hatching 36*b* indicates a form of operation for effecting the joining by the press-contacting joint connector 53.

Therefore, for connecting the wire 10D and the branch wire 40D together, the wire 10D and the branch wire 40D are arranged in such a manner that the operation range 12*a* of the wire 10D and the operation range 12*b* of the branch wire 40D are disposed in registry with each other as shown in FIG. 6(A). Then, the two 10D, 40D are joined by a press-contacting blade 54 of the press-contacting joint connector 53 as shown in FIG. 6(B).

Namely, the press-contacting blade 54 is secured to the two operation ranges 12*a* and 12*b*.

As described above, in the above-mentioned wire, the wire connecting method and wire harness, the operation is carried out according to the contents described at the first marking 24*a* and the second marking 35*a*, and by doing so, the proper connecting operation can be carried out.

At this time, it is not necessary to see other materials such as a manual, and therefore the wire harness 60D can be easily formed.

Figure 7:
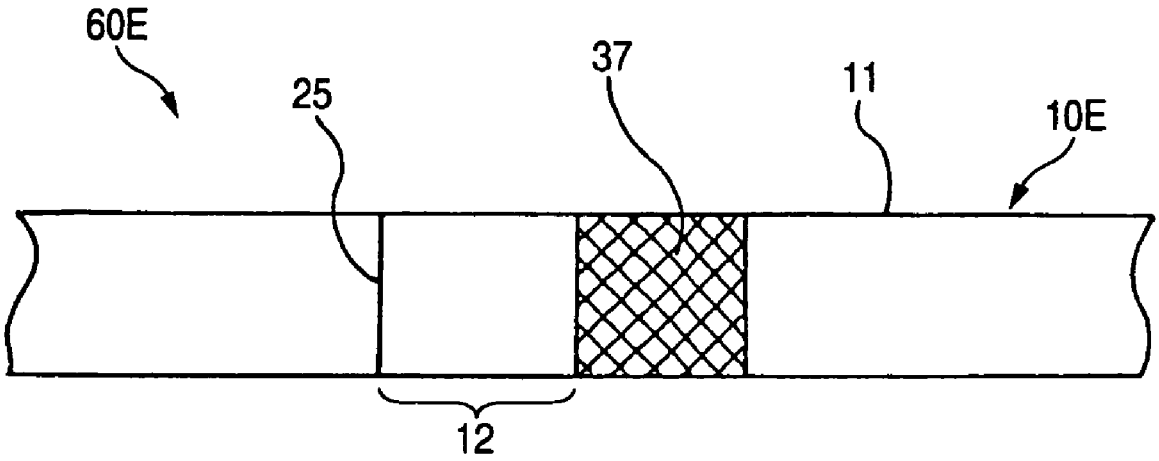
FIG. 7 is an explanatory view showing a wire, a wire connecting method and a wire harness according to a fifth embodiment of the present invention.

Next, a wire, a wire connecting method and a wire harness, according to a fifth embodiment of the present invention, will be described in detail with reference to the drawings. FIG. 7 is an enlarged view of the fifth embodiment of the wire of the present invention.

Those portions identical to those of the above-mentioned embodiments will be designated by identical reference numerals, respectively, and repeated explanation will be omitted.

As shown in FIG. 7, a first marking 25 and a second marking 37 are provided on a covering sheath 11 of the wire 10E of the fifth embodiment of the present invention. The first marking 25 is a ring, and the second marking 37 has a shading pattern.

Therefore, a region, lying between the first marking 25 and the second marking 37, defines an operation range 12. The second marking 37 indicates an operation form, and the shading pattern indicates that there is the next operation.

As described above, in the above-mentioned wire, wire connecting method and wire harness, the operation is carried out according to the contents described at the first marking 25 and the second marking 37, and by doing so, the proper connecting operation can be carried out.

At this time, it is not necessary to see other materials such as a manual, and therefore the wire harness 60E can be easily formed.

Figure 8:
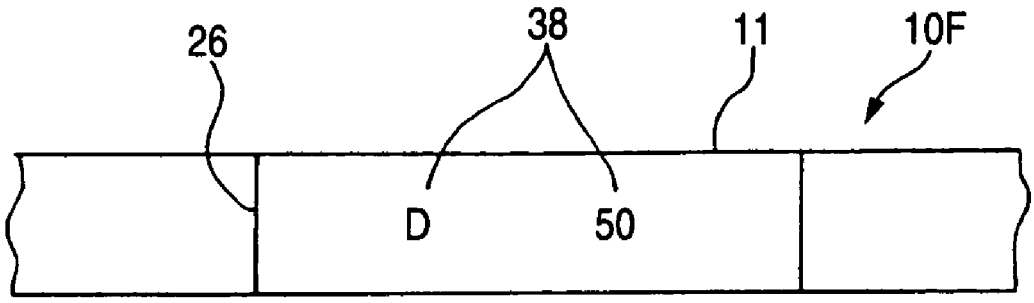
FIGS. 8(A) and 8(B) are explanatory views showing a wire, a wire connecting method and a wire harness according to a sixth embodiment of the present invention.
Figure 8:
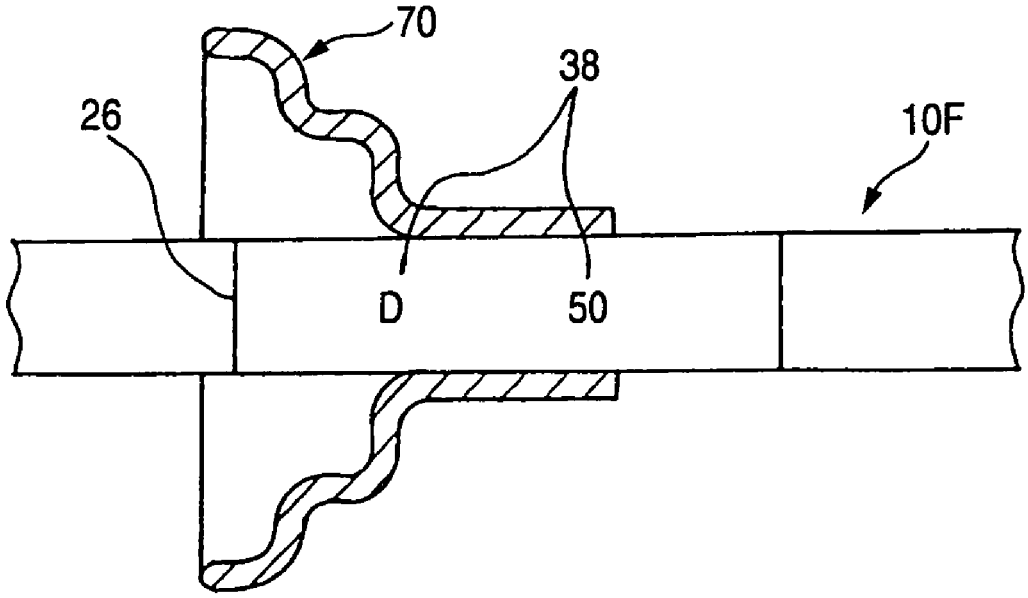

Next, a wire, a wire connecting method and a wire harness, according to a sixth embodiment of the present invention, will be described in detail with reference to the drawings. FIGS. 8(A) and 8(B) are enlarged views of the sixth embodiment of the wire of the present invention. Those portions identical to those of the above-mentioned embodiments will be designated by identical reference numerals, respectively, and repeated explanation will be omitted.

As shown in FIG. 8(A), a first marking 26 and a second marking 38 are provided on a covering sheath 11 of the wire 10F of the sixth embodiment of the present invention.

The first marking 26 is a ring-like mark, and the second marking 38 is lettering "D50" indicating an operation form, and "D" indicates a waterproof treatment, and "50" indicates the kind of a waterproof plug.

Therefore, a grommet 70, designated by "50", is mounted on a region between the first marking 26 and the second marking 38 as shown in FIG. 8(B).

As described above, in the above-mentioned wire, the wire connecting method and wire harness, the operation is carried out according to the contents described at the first marking 26 and the second marking 38, and by doing so, the proper connecting operation can be carried out. At this time, it is not necessary to see other materials such as a manual, and therefore the operation can be easily carried out.

The wires, the wire connecting methods and the wire harnesses of the present invention are not limited to the above embodiments, and suitable changes, improvements and so on can be made.

Figure 9:
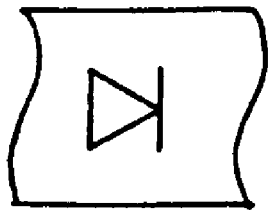
FIGS. 9(A) to 9(D) are examples of the first marking.
Figure 9:
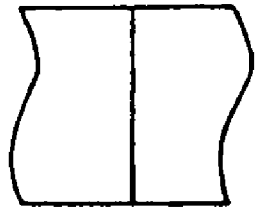
Figure 9:
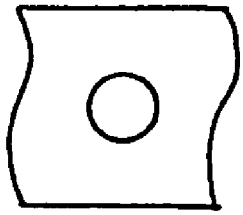
Figure 9:
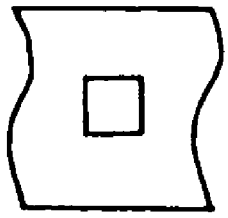

For example, although the triangular mark shown in FIG. 9(A) and the ring-like mark shown in FIG. 9(B) have been illustrated as the signs of the first markings 20, 21, 23, 24, 25, 26, the markings are not limited to these marks, and any other mark, such as a round shape shown in FIG. 9(C) and a square shape shown in FIG. 9(D), can be illustrated.

Figure 10:
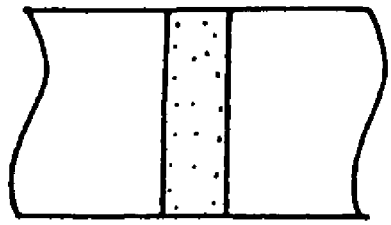
FIGS. 10(A) to 10(C) are examples of the second marking.
Figure 10:
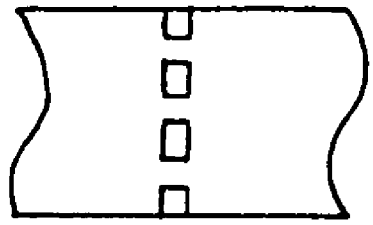
Figure 10:
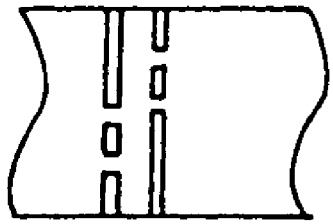
Figure 11:
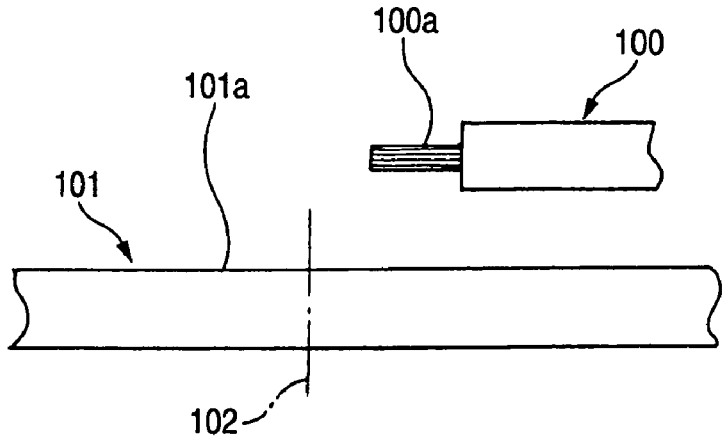
FIG. 11 (A) PRIOR ART
FIGS. 11(A) and 11(B) are explanatory views showing a conventional ordinary wire connecting method.
Figure 11:
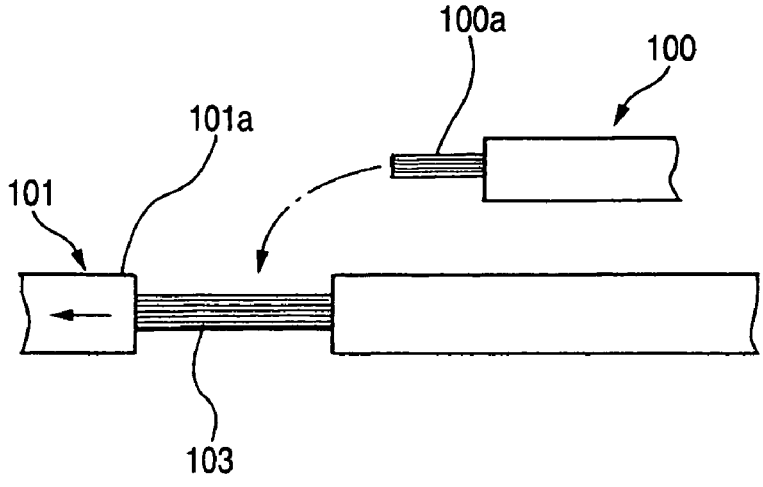
FIG. 11 (B) PRIOR ART

Also, as the signs of the second markings 30, 31, 34, 35, 37, 38, a ring-like mark (shown in FIG. 10(A), varied in thickness and color, a broken-line ring and a dot-and-dash line ring shown respectively in FIGS. 10(B) and 10(C) and so on can be illustrated. Furthermore, a combination of various rings, lettering and so on can be used.

As described above, in the wires, the wire connecting methods and the wire harnesses of the present invention, the operation whose operation form is indicated by the second marking is carried out at the region indicated by the first marking (which is the indicating member) provided on the covering sheath of the wire, and therefore the predetermined operation can be carried out at the predetermined position without a mistake.

Although the present invention have been described in detail with reference to the specific embodiments, it will clear to those versed in the art that various changes and modifications can be added without departing from the spirits and scope of the present invention.

The present Application is based on Japanese Patent Application (Patent Application No. 2003-129161) filed on May 7, 2003, and its contents are incorporated herein as a reference.

INDUSTRIAL APPLICABILITY

The wire, the wire connecting method and the wire harness of the present invention are useful not only as a wire, a wire connecting method and a wire harness used in a vehicle such as an automobile but also as a wire, a wire connecting method and a wire harness used in various apparatuses.

The invention claimed is:

1. A wire, comprising:

an indicating member provided on a covering sheath of the wire, wherein the indicating member indicates an operation region;

wherein the indicating member includes a first marking and a second marking which are provided at a predetermined interval along a longitudinal direction of the covering sheath; and wherein the first marking indicates an operation position, and the second marking indicates an operation form.

2. The wire according to claim 1, wherein the first marking indicates the operation position arranged between the first marking and the second marking.

3. The wire according to claim 2, wherein the first marking indicates a connecting position to which a branch wire is to be connected; and wherein the second marking indicates the number of the branch wire and an installation direction of the branch wire.

4. The wire according to claim 2, wherein at least one of the first marking and the second marking is formed by a heat-sensitive paint.

5. The wire according to claim 1, wherein the first marking indicates a connecting position to which a branch wire is to be connected; and wherein the second marking indicates the number of the branch wire and an installation direction of the branch wire.

6. The wire according to claim 5, wherein at least one of the first marking and the second marking is formed by a heat-sensitive paint.

7. The wire according to claim 1, wherein at least one of the first marking and the second marking is formed by a heat-sensitive paint.

8. The wire connecting method of connecting a second wire, serving as a branch wire, to a predetermined position of a first wire serving as a main wire; the wire connecting method, comprising:

beforehand providing a first marking and a second marking at a predetermined interval along a longitudinal direction of a covering sheath of the first wire;

connecting the second wire in accordance with a connecting position indicated by the first marking; and installing the second wire in accordance with a connection form indicated by the second marking.

9. A wire harness formed by a wire connecting method of connecting a second wire, serving as a branch wire, to a predetermined position of a first wire serving as a main wire; wherein the wire harness is produced by the wire connecting method, comprising:

beforehand providing a first marking and a second marking at a predetermined interval along a longitudinal direction of a covering sheath of the first wire;

connecting the second wire in accordance with a connecting position indicated by the first marking; and installing the second wire in accordance with a connection form indicated by the second marking.

* * * * *